United States Patent [19]

Tsukagoshi et al.

[11] 4,135,601

[45] Jan. 23, 1979

[54] BORON COATED DIAPHRAGM FOR USE IN A LOUD SPEAKER

[75] Inventors: Tsunehiro Tsukagoshi; Teruo Touma; Masami Kimura, all of Tokyo, Japan

[73] Assignee: Pioneer Electronic Corporation, Tokyo, Japan

[21] Appl. No.: 892,578

[22] Filed: Apr. 3, 1978

Related U.S. Application Data

[63] Continuation of Ser. No. 699,399, Jun. 24, 1976, abandoned.

[30] Foreign Application Priority Data

Jun. 24, 1975 [JP] Japan ..... 50-76816

[51] Int. Cl.[2] ..... G10K 13/00; H04R 7/12

[52] U.S. Cl. ..... 181/167; 179/181 R; 181/168; 181/170; 428/80; 428/195; 428/457; 428/538

[58] Field of Search ..... 179/181 R; 181/167, 181/170, 168, 169; 427/DIG. 10; 428/910, 913

[56] References Cited

U.S. PATENT DOCUMENTS

| | | | |
|---|---|---|---|
| 3,093,207 | 6/1963 | Bozak | 181/167 X |
| 3,125,647 | 3/1964 | Rouy | 179/181 R |
| 3,564,565 | 2/1971 | Haberecht et al. | 428/538 |
| 3,671,306 | 6/1972 | Allen | 428/457 X |
| 3,702,261 | 11/1972 | Feakes et al. | 427/DIG. 10 X |
| 3,729,372 | 4/1973 | Matchen et al. | 428/457 X |
| 3,807,008 | 4/1974 | Reedy | 427/DIG. 10 X |
| 3,858,680 | 1/1975 | Tsuge et al. | 181/167 X |
| 4,005,235 | 1/1977 | Prochazka | 428/538 X |

*Primary Examiner*—George F. Lesmes
*Assistant Examiner*—R. Eugene Varndell, Jr.
*Attorney, Agent, or Firm*—Sughrue, Rothwell, Mion, Zinn and Macpeak

[57] ABSTRACT

A diaphragm for use in a loud speaker is constructed of a substrate formed into a diaphragm configuration from a thin plate or a sheet composed of an organic or an inorganic substance, and a coating layer made of boron, or, an alloy of which a major component is boron or a chemical compound of boron, being provided onto at least the surface of said substrate.

12 Claims, 2 Drawing Figures

FIG. 1
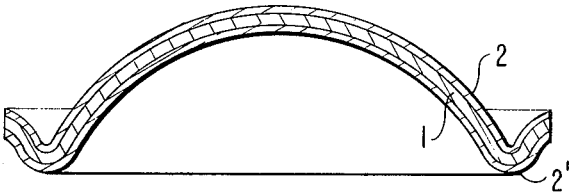
FIG. 2A
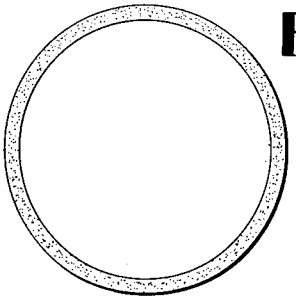
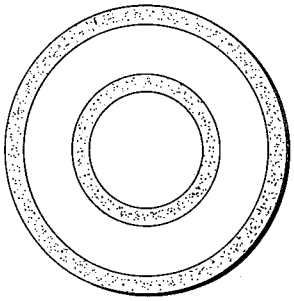
FIG. 2B
FIG. 2C
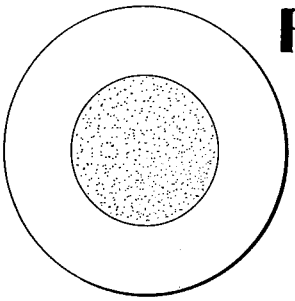
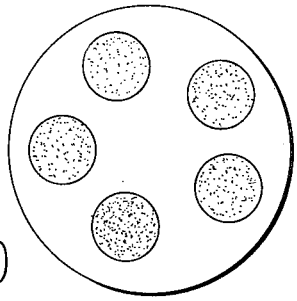
FIG. 2D
FIG. 2E
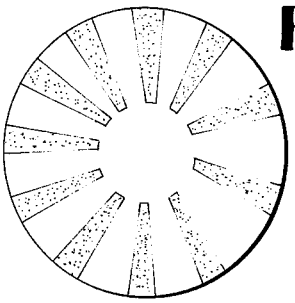
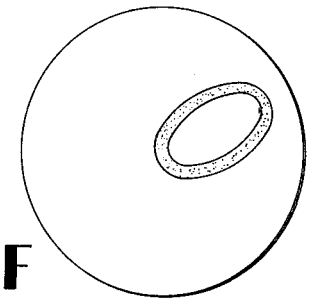
FIG. 2F

BORON COATED DIAPHRAGM FOR USE IN A LOUD SPEAKER

This is a continuation, of application Ser. No. 699,399, filed June 24, 1976, now abandoned.

BACKGROUND OF THE INVENTION

The present invention relates to diaphragms for use in loud speakers, and more particularly, to diaphragms of the dome-shaped type.

Conventionally, aluminum or titanium were used for the most part as the material of a diaphragm because of their lightness in weight and their facility in rolling treatment. Those materials, however, produce a particular vibrating mode over the diaphragm so that in the high-frequency characteristic of the diaphragm, there appears a peak portion thereby causing the reproduced tone qualities to be considerably degraded. For the purpose of avoiding the disadvantage encountered, it has been recognized that a material having a large ratio of Young's modulus E to density $\rho$ is preferable therefor in order to obtain a highly efficient diaphragm (See Table 1). Because of this recognition beryllium, or beryllium alloy has been used as the material for diaphragms.

Beryllium or beryllium alloy are similar to aluminum in that the surfaces thereof are not corroded due to the formation of oxidizing films thereon. However, the surfaces thereof can be corroded by certain environments, such as in sulfurous acid gas, and may suffer from the recent terrific air pollution which includes corrosive gasses, such as sulfurous acid gas, caused mainly by the exhaust gas from automobiles and the exhaust smoke from industries.

Table 1

| | Young's modulus Kg/mm$^2$ | Density $\rho$ g/cc | $E/\rho$ $10^{-6}$ cc/mm$^2$ |
|---|---|---|---|
| Aluminum | 7,400 | 2.65 | 2,750 |
| Boron carbide | 46,000 | 2.51 | 18,326 |
| Beryllim | 28,000 | 1.84 | 15,217 |
| Boron | 45,000 | 2.46 | 18,292 |

SUMMARY OF THE INVENTION

It is therefore an object of this invention to provide a noncorrosive diaphragm which is unaffected in the invironment of corrosive gas.

Another object of this environment is to provide a diaphragm having a ratio of Young's modulus E to density $\rho$ which is as large as beryllium or beryllium alloy so as to obtain a highly efficient loud speaker.

Still another object of this invention is to provide a diaphragm which can be manufactured inexpensively owing to the fact that the material for the coating layer is supplied inexpensively.

BRIEF DESCRIPTION OF THE DRAWINGS

FIG. 1 represents the central cross sectional view of a diaphragm for use in a loud speaker embodying the present invention.

FIGS. 2A–2F are top views of diaphragms which are only partially coated in accordance with the present invention.

DETAILED DESCRIPTION OF PREFERRED EMBODIMENTS

Referring to FIG. 1, reference numeral (1) designates a substrate formed into a diaphragm configuration from a thin plate made of aluminum or titanium by means of a press manufacturing technique. A coating layer (2), (2)', provided on one or both surfaces of the substrate, is boron, an alloy of boron having boron as its major component, or a chemical compound of boron. The coating can be applied by means of electron beam evaporation, ion plating, sputtering or the like.

The coating layer of boron finely adheres to the aluminum substrate. That is, some of the coating layer material diffuses into the substrate (1) so that the layer cannot be peeled away. The average Young's modulus of the entire diaphragm gets nearer to that of boron, and the adhesion of boron to aluminum is more securely effected.

In the above embodiment, although aluminum is referred to as the material of the substrate, organic substances, such as a synthetic resin, may be employed instead of aluminum. It will be noted that the value of $E/\rho$ of a diaphragm would be increased if beryllium or beryllium alloy is used as the substrate. In the latter case, since $E/\rho$ of the substrate per se is relatively large, the coating layer (2), (2)' can be as thin as 1$\mu$ to prevent corrosion, even from sulfurous acid gas.

Also the substrate may consist of other materials initially coated with beryllium or beryllium alloy. The latter substrate is then coated with an alloy of which a major component is boron or a chemical compound of boron.

In summary, an organic or inorganic substance, such as aluminum, titanium, beryllium or synthetic resin or the like are employed as the substrate, and boron, or an alloy of which a major component is boron or a chemical compound of boron, is coated onto the surface of the substrate, whereby a diaphragm having sufficiently large value of $E/\rho$ can be obtained as illustrated heretofore, and accordingly a highly efficient loud speaker can be obtained. Further, the coating layer is chemically protected, and thus is not corroded by the corrosive gas. Furthermore, a diaphragm according to the present invention is capable of being manufactured inexpensively. In case the substrate is beryllium or beryllium alloy, even though the coating layer is very thin, the same result is achieved.

Although suitable thickness in any particular case may be easily determined by routine checking of the acoustical characteristics of samples of diaphragms, it should be understood that the preferred thickness of the coating depends upon the substrate material, thickness and diameter. As an example, for a diaphragm of 25 mm diameter consisting of a 15–20$\mu$m thick aluminum sheet, the minimum coating thickness is 3–5$\mu$m and the maximum coating thickness is 30–40$\mu$m.

While pure boron is the most preferable coating, pure boron does not occur naturally and is expensive to obtain. Alloys of boron are suitable provided they contain 50% by weight of boron. Of course, the greater the weight percent of boron, the better. Typical alloys are those which include aluminum and titanium. Boron compounds which are suitable include boron carbide and boron nitride.

The coating may be applied to only parts of the surface or surfaces of the substrate as shown in the top views of FIGS. 2A–2F. FIG. 2A shows a plan view of a diaphragm, the peripheral portion of which is coated with a suitable coating material. That is, the portion of the diaphragm by which it is supported is selectively coated. With this construction, it is possible to increase the rigidity of the support portion without increasing the mass of the diaphragm substantially. The result is that the resonance frequency of the diaphragm in the high frequency region can be made higher, preferably higher than the upper limit of the audible range, to thereby cause the reproduction range of the loud speaker to be widened.

The portion of the diaphragm which is to be selectively coated is arbitrary selected according to demands. For example, FIG. 2B shows coaxial coating zones and FIG. 2C shows a center coating zone. Further, FIG. 2D shows a plurality of coating zones arranged on a coaxial line, and FIG. 2E shows a plurality of radial coating zones. By arranging the coating zones symmetrically with respect to the center of the diaphragm, it may be possible to induce desirable local vibration while reducing undesirable vibrations. By suitably arranging them, it may be possible to flatten the frequency response of the loud speaker. Further, FIG. 2F shows an elliptical coating zone. When the coating zone is neither coaxial nor symmetrical, as in the case shown in FIG. 2F, the generation of standing waves is substantially eliminated and desirable local vibrations can be produced in, particularily, the high frequency range, thereby contributing to the flattening of the frequency response.

What is claimed is:

1. In a dome-shaped diaphragm of a loud speaker, said diaphragm being of the type constructed of a thin sheet of material shaped into the form of the diaphragm, the improvement characterized by, a coating on at least a part of one surface of said thin sheet of material, said coating being a material selected from the group consisting of boron, an alloy having boron as its major component and a chemical compound of boron.

2. A diaphram as claimed in claim 1 wherein at least one surface of said thin sheet is completely coated with said material.

3. A diaphragm as claimed in claim 1 wherein said thin sheet of material is aluminum.

4. A diaphram as claimed in claim 1 wherein said thin sheet of material is titanium.

5. A diaphragm as claimed in claim 1 wherein said thin sheet of material is synthetic resin.

6. A diaphram as claimed in claim 1 wherein said thin sheet of material is beryllium.

7. A diaphram as claimed in claim 1 wherein said thin sheet of material is an alloy of beryllium.

8. A diaphragm as claimed in claim 1 wherein said thin sheet of material has a coating of beryllium or an alloy of beryllium over which said coating material in which boron is the major component is coated.

9. A diaphragm as claimed in claim 1 wherein said chemical compound is boron carbide.

10. A diaphragm as claimed in claim 1 wherein said chemical compound is boron nitride.

11. A diaphragm as claimed in claim 1 wherein said alloy is an alloy of boron and aluminum.

12. A diaphragm as claimed in claim 1 wherein said alloy is an alloy of boron and titanium.

* * * * *